US012421073B2

(12) United States Patent
Huang

(10) Patent No.: US 12,421,073 B2
(45) Date of Patent: Sep. 23, 2025

(54) TAPE UNWINDING DEVICE WITH SELF-LOCKING FUNCTION

(71) Applicant: FUJIAN JIALONG ADHESIVE TAPE CO.,LTD., Zhangzhou (CN)

(72) Inventor: Benyu Huang, Ningde (CN)

(73) Assignee: Kingnode America Inc., Atlanta, GA (US)

( * ) Notice: Subject to any disclaimer, the term of this patent is extended or adjusted under 35 U.S.C. 154(b) by 144 days.

(21) Appl. No.: 18/412,542

(22) Filed: Jan. 14, 2024

(65) Prior Publication Data

US 2025/0230010 A1 Jul. 17, 2025

(51) Int. Cl.
*B65H 49/20* (2006.01)
*B65H 51/32* (2006.01)

(52) U.S. Cl.
CPC ..... *B65H 49/20* (2013.01); *B65H 51/32* (2013.01); *B65H 2403/725* (2013.01); *B65H 2404/1521* (2013.01); *B65H 2701/37* (2013.01)

(58) Field of Classification Search
CPC ..... B65H 59/04
USPC ..... 242/422, 422.4, 422.9
See application file for complete search history.

(56) References Cited

U.S. PATENT DOCUMENTS 2,766,945 A * 10/1956 Reich ..... H01F 41/094 242/421.3
2,905,406 A * 9/1959 Falck-Pedersen ..... B65H 49/34 242/422.4
3,598,330 A * 8/1971 Gotschewski ..... G06K 13/24 242/422.4
3,664,597 A * 5/1972 Norman et al. ..... B65H 23/06 242/422.4
3,899,143 A * 8/1975 Slezak ..... B65H 59/04 242/422.4
4,475,695 A * 10/1984 Franks ..... B65H 49/34 74/110
6,457,667 B1 * 10/2002 Golightly ..... B65H 59/04 242/129.8
6,691,945 B2 * 2/2004 Slezak ..... B65H 59/04 242/420
8,628,037 B2 * 1/2014 Slezak ..... B65H 59/04 242/422.4
2006/0081731 A1 * 4/2006 Niederer ..... B65H 59/043 242/421

* cited by examiner

FOREIGN PATENT DOCUMENTS

CN 212558581 U 2/2021
CN 215155931 U 12/2021
CN 215402002 U 1/2022

*Primary Examiner* — William A. Rivera
(74) *Attorney, Agent, or Firm* — Nitin Kaushik

(57) ABSTRACT

The present disclosure provides a tape unwinding device with a self-locking function. When a tape is unwound by the device, a swing arm swings under the action of a tension of the tape until an insert is separated from a shifting card, and then, the tape starts to be unwound, which is beneficial to the reduction of a rotational acceleration during unwinding and the improvement of unwinding stability. When the tape is not acted by an external force due to unwinding ending of the tape, the swing arm swings until the insert is inserted into a limiting slot of the shifting card, and pushes the end of the shifting card to be inserted into a toothed groove, so that the disk gear is stuck by the shifting card, then, a tape roll cannot rotate to be further unwound, and tape loosening caused by self-rotation of the tape roll is avoided.

10 Claims, 12 Drawing Sheets

TAPE UNWINDING DEVICE WITH SELF-LOCKING FUNCTION

TECHNICAL FIELD

The present disclosure relates to the field of unwinding device structures, in particular to a tape unwinding device with a self-locking function.

BACKGROUND

A tape consists of two parts including a substrate and a binder and connects two or more disconnected objects together by binding, and the surface thereof is coated with a layer of adhesive which is self-sticky or is sticky after being wetted.

When a tape is used to seal a carton, a tape roll (i.e., a whole roll of tape) is mounted on a carton sealer, then, the tape is pulled out to be used, and thus, the carton scaling efficiency of the tape can be increased. Usually, the tape roll directly sleeves the outside of a shaft body, the tape roll can rotate, thereby facilitating clamping the tape. However, the tape which is sticky after being wetted (a wet tape for short) is not constrained by stickiness between layers of the tape roll, and therefore, the tape in the tape roll will be loosened after being unwound, which results in poorer stability when the tape is pulled,

SUMMARY

For overcoming defects proposed in the above-mentioned background art, the present disclosure provides a tape unwinding device with a self-locking function.

The present disclosure adopts the following technical solution:

provided is a tape unwinding device with a self-locking function, wherein the device includes:

an outer shaft connected to a mounting frame to rotate, a tape roll sleeving the outer shaft so as to be fixed relative to the outer shaft;

a disk gear fixedly connected with the outer shaft;

a shifting card connected to the mounting frame to rotate, a first torsional spring being mounted between the shifting card and the mounting frame, and the shifting card being pulled by a torsion of the first torsional spring to swing to the disk gear, so that the shifting card swings to be inserted into a toothed groove of the disk gear; and a swing arm connected to the mounting frame to rotate, one end of the swing arm being provided with a driving roller, and a tape passing by the driving roller after being pulled out, so that the tape drags the driving roller and drives the swing arm to swing to a direction away from the shifting card;

wherein one side of the swing arm is further provided with an insert, and when the tape is not pulled out, the swing arm swings until the insert supports against the shifting card to be away from an end inserted into the toothed groove, so that the shifting card swings to be inserted into the toothed groove.

In a possible implementation, a bearing block is fixed on the mounting frame, a first bearing is embedded and fixed in the bearing block, and the outer shaft is fixed in an inner ring of the first bearing.

In a possible implementation, an expansion sleeve is fixed outside the outer shaft, and a through hole in the center of the tape roll fixedly sleeves a cylindrical surface sleeving outside the expansion sleeve, so that the tape roll is fixed relative to the outer shaft.

In a possible implementation, a bearing block is fixed on the mounting frame, a second bearing is nested and fixed outside the bearing block, one end of the swing arm is provided with a connecting ring, and the connecting ring fixedly sleeves the outside of the second bearing.

In a possible implementation, a clamping slot is formed in the center of the disk gear, an expanded copling sleeve is embedded into the clamping slot in an interference fit way, and the expanded copling sleeve sleeves the outside of the outer shaft in an interference fit way, so that the disk gear is fixed relative to the outer shaft.

In a possible implementation, the device further includes a protective cover fixed on one side of the mounting frame, the disk gear, the shifting card and the first torsional spring are all located in the protective cover, the shifting card is connected to the inside of the protective cover to rotate, an arc-shaped avoidance gap is further formed in one side of the protective cover, and the insert cooperates with the shifting card after passing through the avoidance gap to reach the inside of the protective cover.

In a possible implementation, the protective cover includes a cover shell and a first protective plate, the cover shell is fixed to one side of the mounting frame, an assembly space is formed inside the cover shell, the disk gear, the shifting card and the first torsional spring are all located in the assembly space, an opening of the assembly space is sealed by the first protective plate, and the outer shaft passes through the cover shell to reach the inside of the first protective plate, so that the tape roll is located in the first protective plate after being connected to the outer shaft.

In a possible implementation, the protective cover further includes a second protective plate, and the second protective plate is fixed on the other end, opposite to the first protective plate, of the outer shaft, so that the tape roll is located between the first protective plate and the second protective plate.

In a possible implementation, a central shaft is fixed on the mounting frame, and the central shaft passes through the outer shaft; a clamping part is fixed in the middle of the second protective plate, a connecting hole adapted to an end of the central shaft is formed in the center of the clamping part, a cutting groove is formed in one side of the clamping part, the cutting groove inwards extends to the connecting hole, the clamping part is provided with a notch along a radius line thereof, and the notch communicates with the connecting hole and the cutting groove, so that a part, facing away from the second protective plate after the clamping part is separated by the cutting groove and the notch, of the clamping part forms a clamping piece, and after the connecting hole sleeves the end of the central shaft, the clamping piece moves from one side to the other side of the notch until the connecting hole is tightly clamped by the end of the central shaft.

In a possible implementation, the protective cover further includes a conical sleeve handle, a threaded hole is formed in the second protective plate, the conical sleeve handle is adapted to and spirally connected with the threaded hole, the clamping piece is provided with a moving hole in one side of the notch, the moving hole and the threaded hole are eccentric, the conical sleeve handle is further provided with a conical guide part, and when the conical sleeve handle is screwed into the threaded hole, the guide part supports against a side wall of the moving hole so as to drive a side, provided with the moving hole, of the clamping piece to move to the other side of the notch.

It can be known from the description for the structure of the present disclosure, compared with the prior art, the present disclosure has the following advantages: in a process that a tape is unwound, the swing arm swings anticlockwise under the action of the tension of the tape to separate the insert from the shifting card, so that the shifting card swings to be inserted into the toothed groove of the disk gear under the action of a torsion of the second torsional spring, at the same time, the tape is unwound to drive the disk gear to rotate, a guide surface on an end of the shifting card is pushed out of the toothed groove during rotation of the disk gear, and then, the shifting card is driven to be inserted into the next toothed groove of the disk gear under the action of the torsion of the second torsional spring. Such a circulation is equivalent to the formation of a directional resistance caused during rotation of the disk gear and the outer shaft in an unwinding process by the shifting card, and is beneficial to the reduction of a rotational acceleration during unwinding and the improvement of unwinding stability. When the tape is not acted by an external force due to the ending of the unwinding of the tape, the disk gear stops rotating, at the same time, the swing arm swings under the action of the first torsional spring until the insert is inserted into a limiting slot of the shifting card to push the end of the shifting card to be inserted into the toothed groove and block the shifting card, so that the shifting card cannot swing, then, the disk gear is stuck by the shifting card, and the tape roll cannot rotate to be further unwound. Thus, it can be seen that, by adopting the structure of the present disclosure, the insert pushes the end of the shifting card to be inserted into the toothed groove of the disk gear, so that the outer shaft can be self-locked and fixed, the tape roll fixedly sleeving the outside of the outer shaft can be self-locked and fixed, a situation that the tape is loosened due to self-rotation of the tape roll can be avoided, and affecting the stability of pulling the tape later can be avoided.

DETAILED DESCRIPTION OF THE EMBODIMENTS

In order to make objectives, technical solutions and advantages of the present application clearer, the present application will be further described in detail below in conjunction with the accompanying drawings.

Below, terms such as "first" and "second" are for descriptive purposes only, and cannot be understood as indicating or implying the relative importance or implicitly indicating the number of indicated technical features. Therefore, the features defined as "first" and "second" may explicitly or implicitly include at least one of the features.

In addition, in the present application, directional terms such as "upper" and "lower" are defined relative to directions where components are schematically placed in the accompanying drawings. It should be understood that these directional terms are relative concepts, are used for relative description and clarification, and can be changed accordingly according to the change of the directions where the components are placed in the accompanying drawings.

Figure 1:
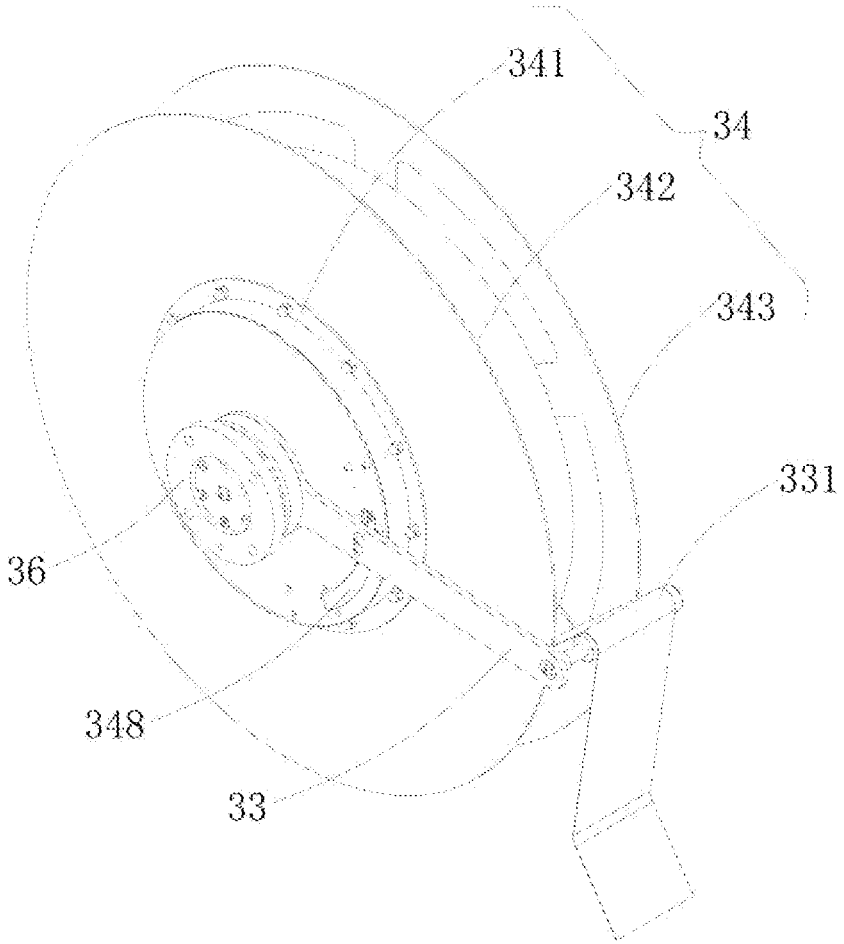
FIG. 1 is a schematic view of a three-dimensional structure viewed from one side of the present disclosure.
Figure 2:
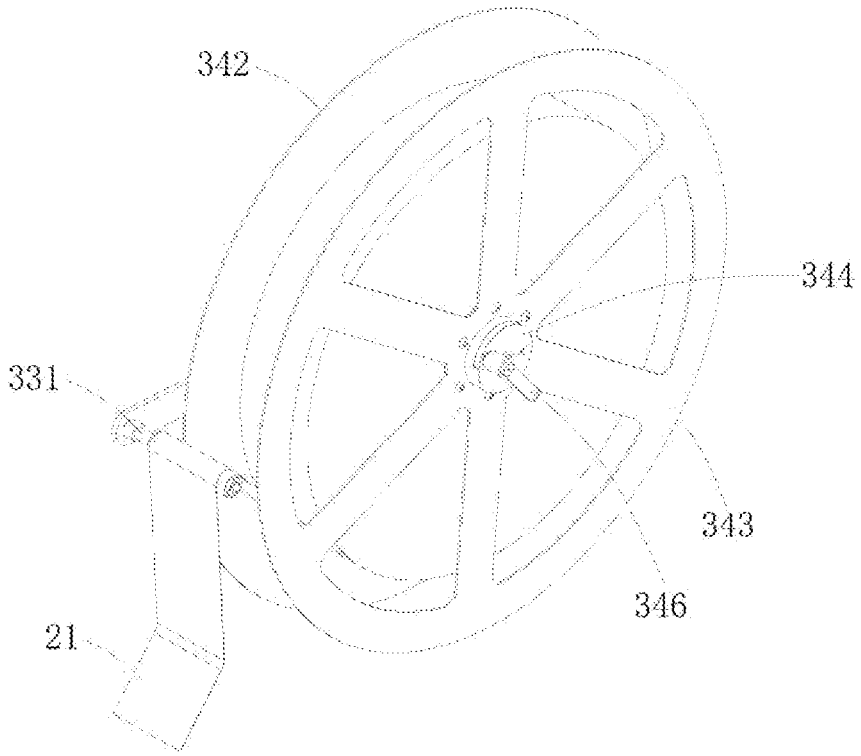
FIG. 2 is a schematic view of a three-dimensional structure viewed from the other side of the present disclosure.

The present disclosure discloses a tape unwinding device with a self-locking function, as shown in FIG. 1 and FIG. 2, the device includes an outer shaft 31, a disk gear 32, a shifting card 35, a swing arm 33 and a protective cover 34. A carton sealer is provided with a mounting frame (unshown in the figures) for mounting the tape unwinding device, the outer shaft 31 is connected to the mounting frame to rotate, and after a tape roll 2 is fixed relative to the outer shaft 31 after sleeving the outer shaft 31, so that the tape roll 2 can smoothly rotate with the outer shaft 31 as an axis after a tape 21 in the tape roll 2 is pulled out of a device relevant to the carton sealer.

Figure 3:
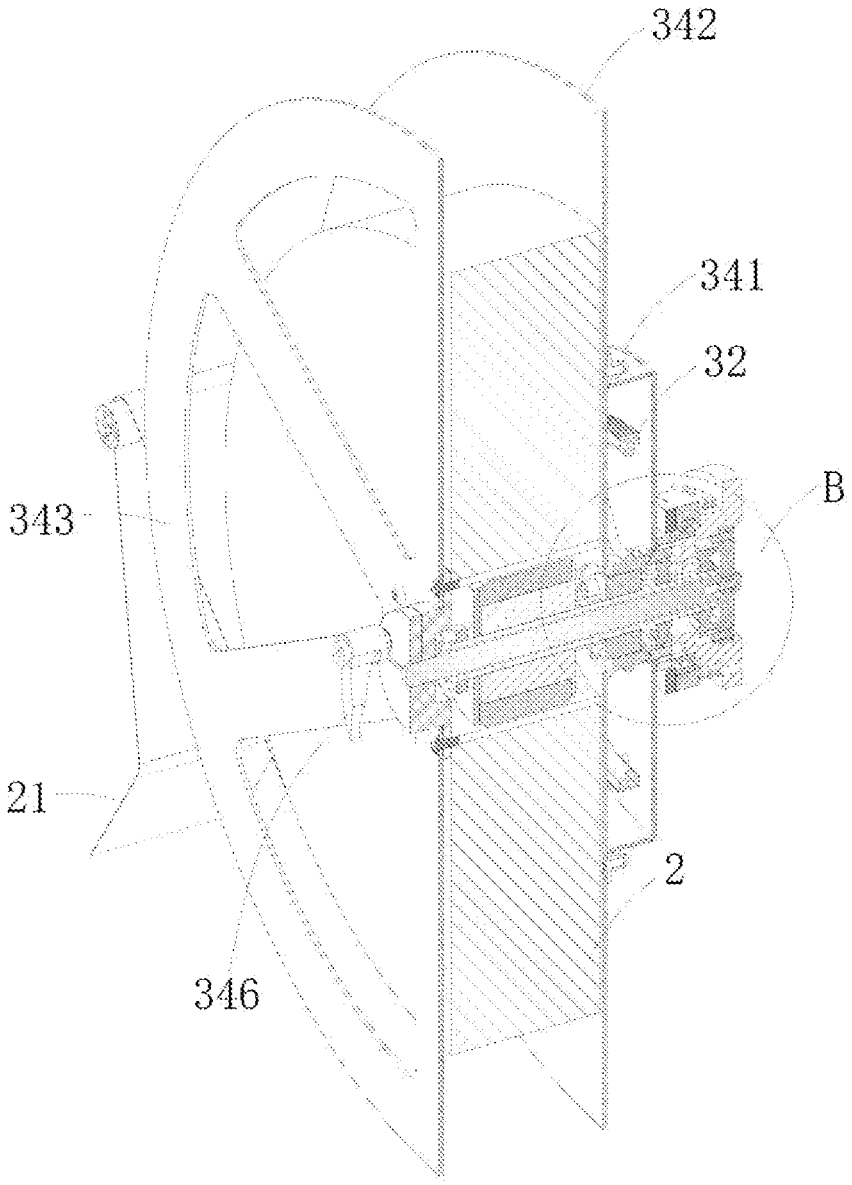
FIG. 3 is a schematic lateral sectional view of a three-dimensional structure of the present disclosure.
Figure 4:
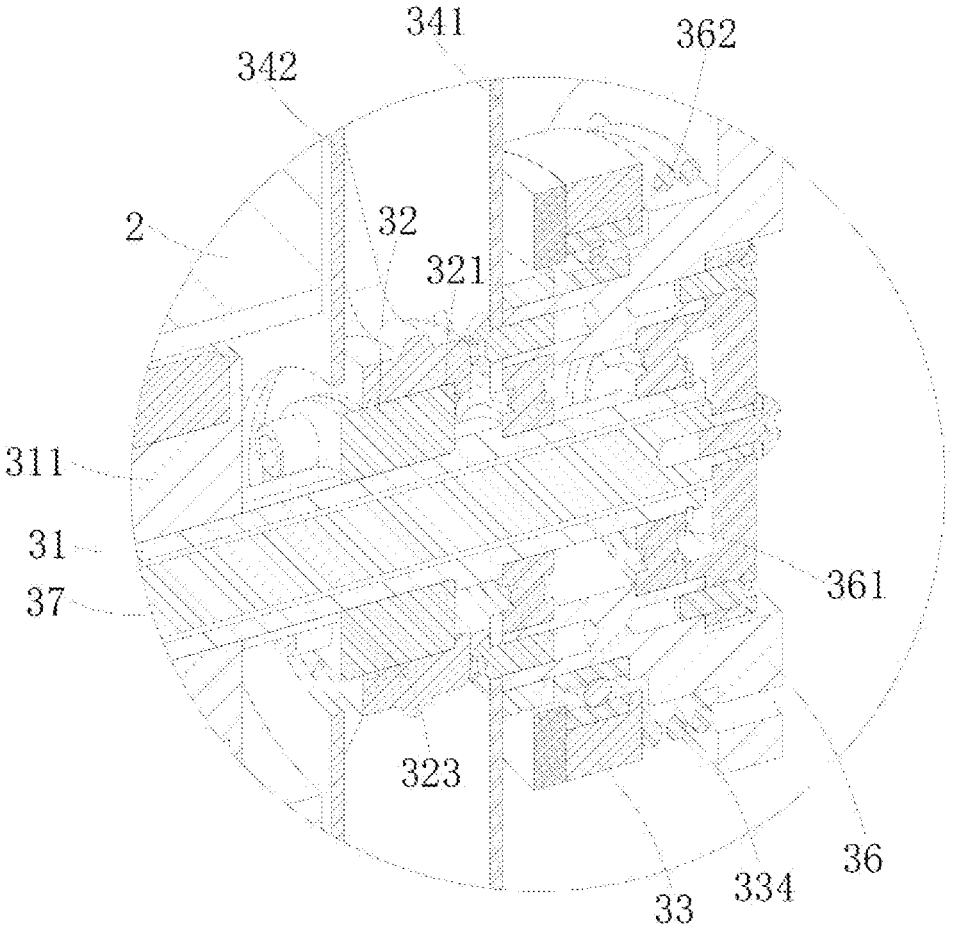
FIG. 4 is a schematic enlarged view of part A in FIG. 3.

As shown in FIG. 3 and FIG. 4, a bearing block 36 is fixed on the mounting frame, a first bearing 361 is fixed in the bearing block 36, and the outer shaft 31 is connected with an inner ring of the first bearing 361 in an interference fit way, and a structure that the outer shaft 31 rotates relative to the mounting frame can be formed by such a fixed connection structure of the bearing block 36. A clamping slot 321 is formed in the center of the disk gear 32, an expanded copling sleeve 323 is embedded into the clamping slot 321 in an interference fit way, and the expanded copling sleeve 323 sleeves the outside of the outer shaft 31 in an interference fit way, so that the disk gear 32 is fixedly connected with the outer shaft 31. In addition, an expansion sleeve 311 is further fixed outside the outer shaft, and a through hole in the center of the tape roll 2 sleeves a cylindrical surface outside the expansion sleeve 311 so as to be fixed, so that the tape roll 2 is fixed relative to the outer shaft 31, so that the tape roll 2 rotates relative to the mounting frame, and the disk gear 32 rotates therewith while the tape roll 2 rotates.

The protective cover 34 is fixed to the mounting frame by the connection of the bearing block 36, the protective cover 34 includes a first protective plate 342 and a cover shell 341. An assembly space is formed inside the cover shell 341, and a surface, facing away from an opening of the assembly space, of the cover shell 341 is fixed to the bearing block 36, which is equivalent to that the cover shell 341 is fixed to one side of the mounting frame. The disk gear 32, the shifting card 35 and a first torsional spring 351 are all located in the assembly space, the assembly space is sealed by the first protective plate 342, the first protective plate 342 is fixedly connected with the cover shell 341, and the outer shaft 31 penetrates out of the assembly space and passes through the first protective plate 342, so that the tape roll 2 may be directly fixedly connected with the expansion sleeve 311 of the outer shaft 31.

Figure 5:
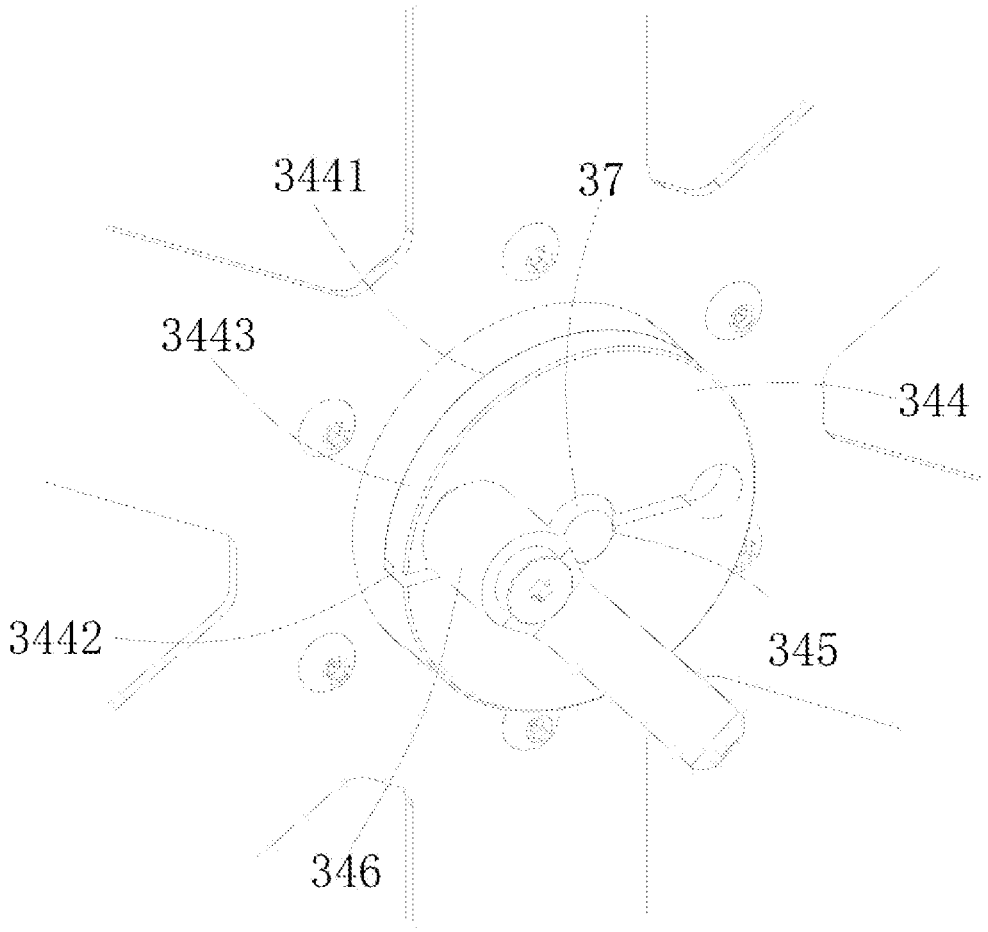
FIG. 5 is a schematic view of a three-dimensional structure for fixed connection between a second protective plate and a central shaft.
Figure 6:
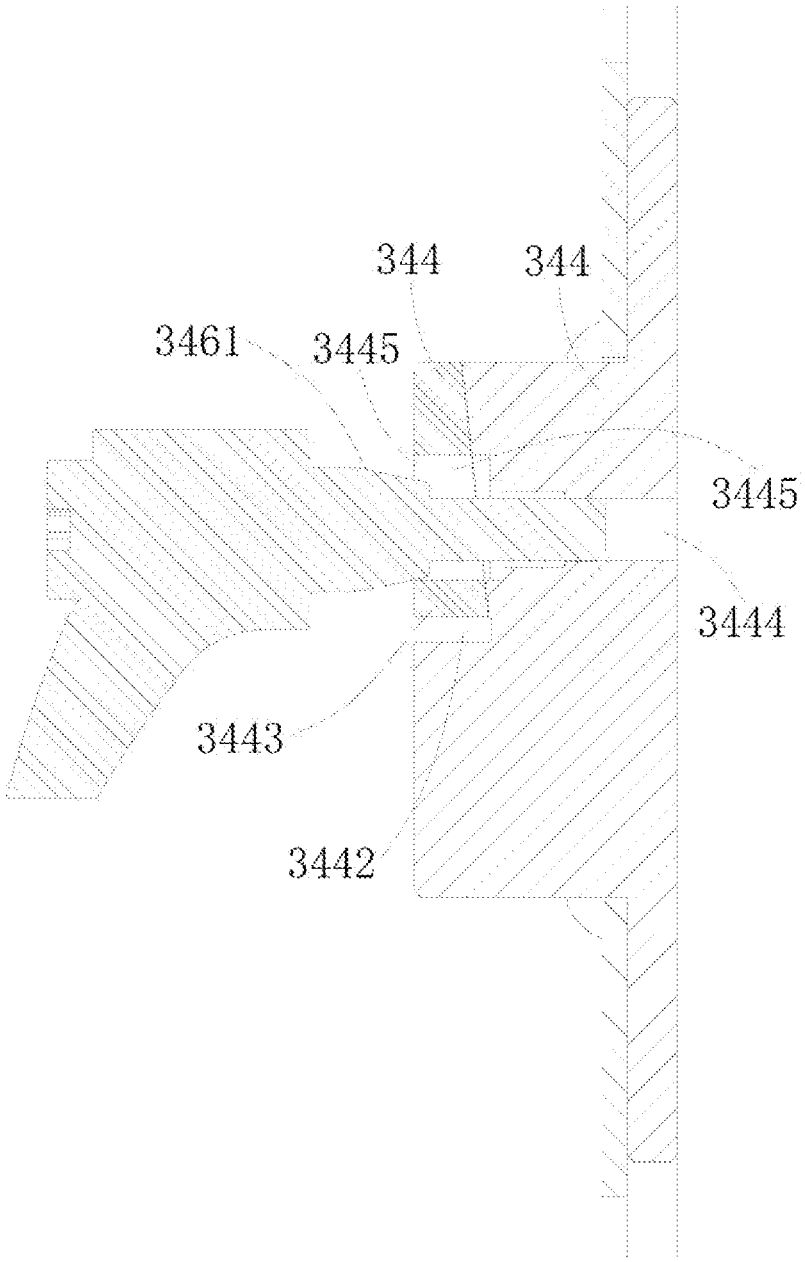
FIG. 6 is a schematic sectional view obtained after a conical sleeve handle is screwed in a threaded hole in a clamping part.

Further, as shown in FIG. 5 and FIG. 6, the protective cover 34 further includes a second protective plate 343, and the second protective plate 343 is fixed on the other end, opposite to the first protective plate 342, of the outer shaft 31, so that the tape roll 2 is located between the first protective plate 342 and the second protective plate 343, which plays a role in protecting the tape roll 2. A structure that the second protective plate 343 is fixed on the other end of the outer shaft 31 may be mounted by a clamping part 344, a conical sleeve handle 346 and a central shaft 37. Specifically, an end surface on one end of the central shaft 37 is fixed relative to the mounting frame by means of the fixed connection of the bearing block 36, and the other end of the central shaft 37 passes through the outer shaft 31. A clamping part 344 is fixed in the middle of the second protective plate 343, and a connecting hole 345 adapted to an end of the central shaft 37 is formed in the center of the clamping part 344. A cutting groove 3441 is formed in one side of the clamping part 344, and the cutting groove 3441 may be a cut which is formed by inwards transverse cutting or oblique cutting from one side of the clamping part and extends to the connecting hole 345. A notch 3442 is further formed in a position along a radius line of the clamping part 344, and the notch 3442 communicates with the connecting hole 345 and the cutting groove 3441, so that a part, facing away from the second protective plate 343 after the clamping part 344 is separated by the cutting groove 3441 and the notch 3442, of the clamping part 344 forms a clamping piece 3443; the clamping piece 3443 forms a structure capable of elastically swinging relative to the notch. 3442; and after the connecting hole 345 sleeves the outside of an end of the central shaft 37, the end of the central shaft 37 can be clamped in the connecting hole 345 by swinging the clamping piece 3443 to one side of the notch 3442, that is, the clamping part 344 and the central shaft 37 can be fixed to each other, so that the second protective plate 343 is also fixed relative to the central shaft 37, and then, the second protective plate 343 is mounted and fixed.

Figure 7:
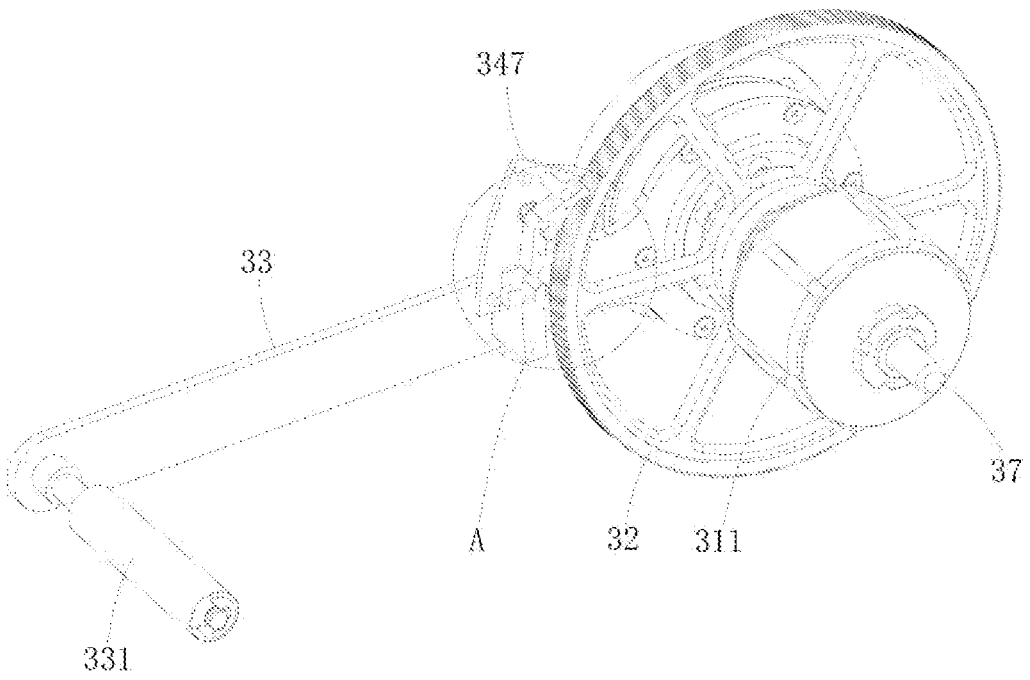
FIG. 7 is a schematic view of a three-dimensional structure with a protective cover being hidden.
Figure 8:
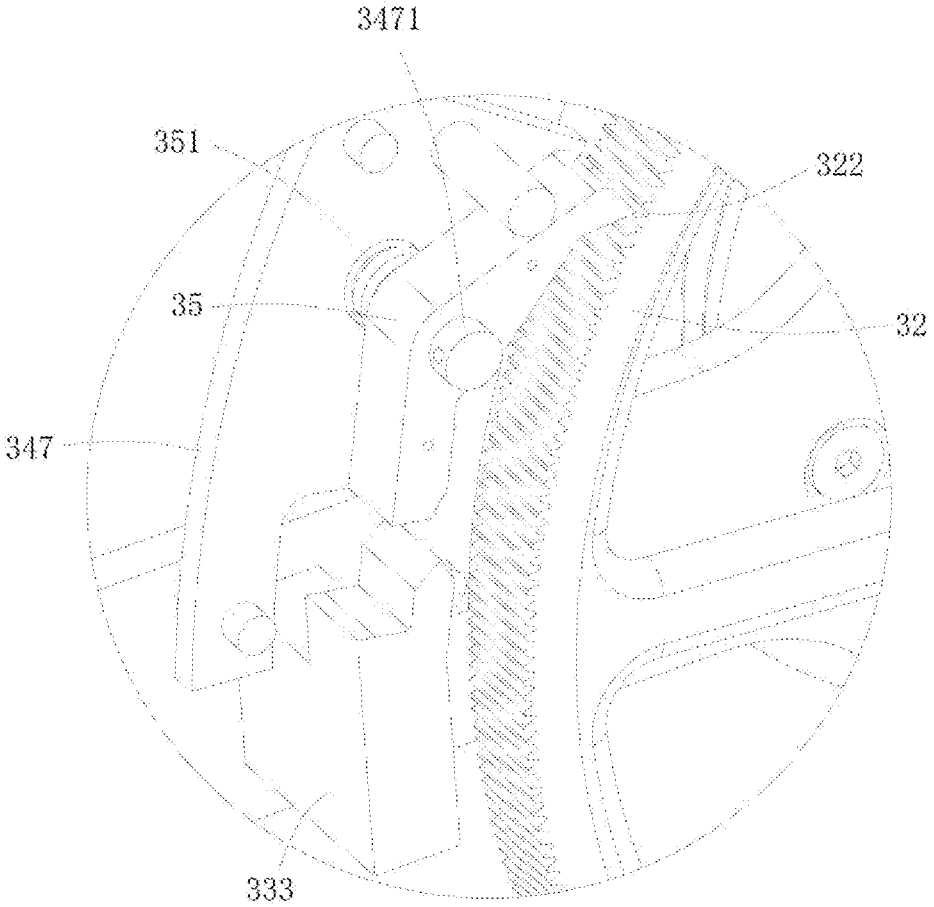
FIG. 8 is a schematic enlarged view of part B in FIG. 7.
Figure 11:
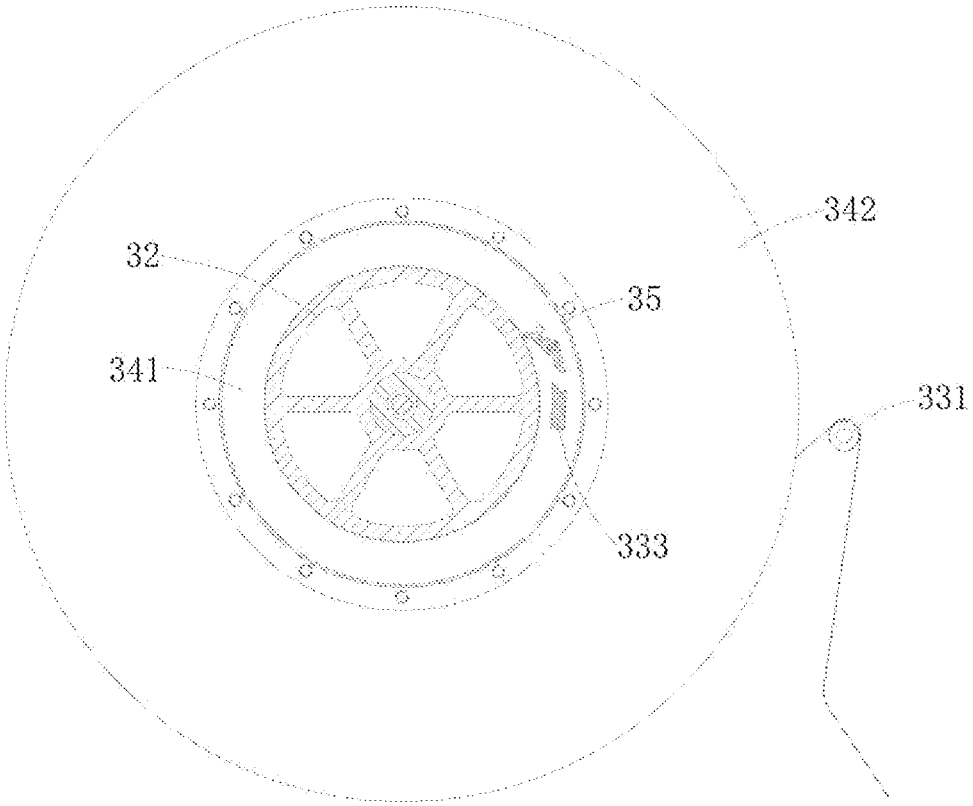
FIG. 11 is a schematic view of a sectional structure on a position of a cover shell of the present disclosure.

Further refer to FIG. 5 and FIG. 6, the clamping part 344 is provided with a threaded hole 3444, and the conical sleeve handle 346 is adapted to and spirally connected with the threaded hole 3444. The clamping piece 3443 is provided with a moving hole 3445 in a side of the notch 3442, and the moving hole 3445 and the threaded hole 3444 are disposed eccentrically (that is, centers of circles are not on the same position). The conical sleeve handle 346 is further provided with a guide part 3461 of a conical structure, and the guide part 3461 is fixed on one end of a stud screwed in the threaded hole 3444; and when the conical sleeve handle 346 is screwed in the threaded hole 3444, the guide part 3461 supports against a side wall of the moving hole 3445 to drive the side, provided with the moving hole 3445, of the clamping piece 3443 to move to the other side of the notch 3442, which ensures that the guide part 3461 is more deeply embedded into the moving hole 3445 when the conical sleeve handle 346 is more tightly screwed in the threaded hole 3444, so that the clamping piece 3443 is driven to move to more tightly clamp the end of the central shaft 37, and then, the second protective plate 343 is fixed relative to the central shaft 37, that is, the second protective plate 343 is fixed on the other end, opposite to the first protective plate 342, of the outer shaft 31, As shown in FIG. 7 and FIG. 8, the cover shell 341 is fixedly provided with a mounting plate 347 in the assembly space, a first bolt 3471 is fixed on the mounting plate 347, and one end of the shifting card 35 passes through and sleeves the outside of the first bolt 3471, so that the shifting card 35 is connected by the protective cover 34 and the first bolt 3471 to rotate on the mounting frame and swing relative to the disk gear 32. The first torsional spring 351 sleeves the other end, opposite to the shifting card 35, of the first bolt 3471, and two ends of the first torsional spring 351 are respectively inserted in surfaces of the cover shell 341 and the shifting card 35, by which the shifting card 35 is limited by the first torsional spring 351, and then, the shifting card 35 is pushed by the torsion of the first torsional spring 351 to swing to the disk gear 32, so that the shifting card 35 swings to be inserted into a toothed groove 322 of the disk gear 32. Further refer to FIG. 11 and FIG. 12, an end, inserted into the toothed groove 322, of the shifting card 35 is provided with an inclined guide surface 352, and when the tape 21 is pulled out to drive the tape roll 2 and the disk gear 32 to rotate, a side of the toothed groove 322 pushes the guide surface 352, so that the shifting card 35 swings to drive the guide surface 352 to leave away from the toothed groove 322. Thus, it can be seen that the end of the shifting card 35 is driven to be inserted into the toothed groove 322 of the disk gear 32 by the torsion of the first torsional spring 351 during unwinding, in a process that the tape roll 2 and the disk gear 32 are driven to rotate while unwinding, the end of the shifting card 35 is pushed out by the rotating toothed groove 322, and thus, a process that the end of the shifting card 35 is inserted into each toothed groove 322 of the disk gear 32 and is pushed out of each toothed groove 322 is formed.

Figure 9:
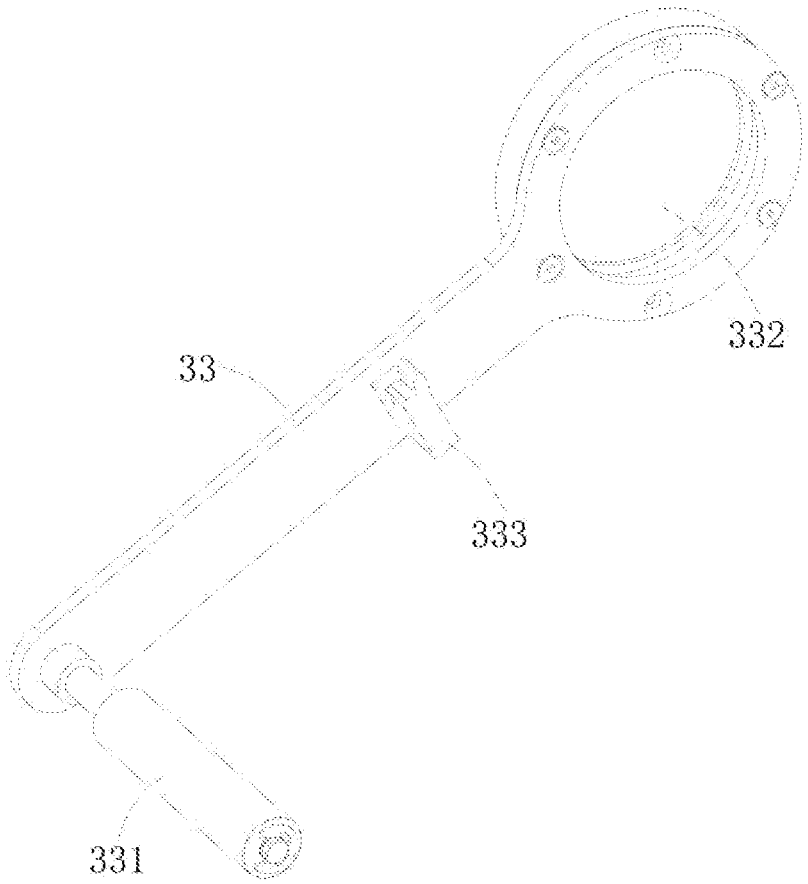
FIG. 9 is a schematic view of a three-dimensional structure of a swing arm.
Figure 10:
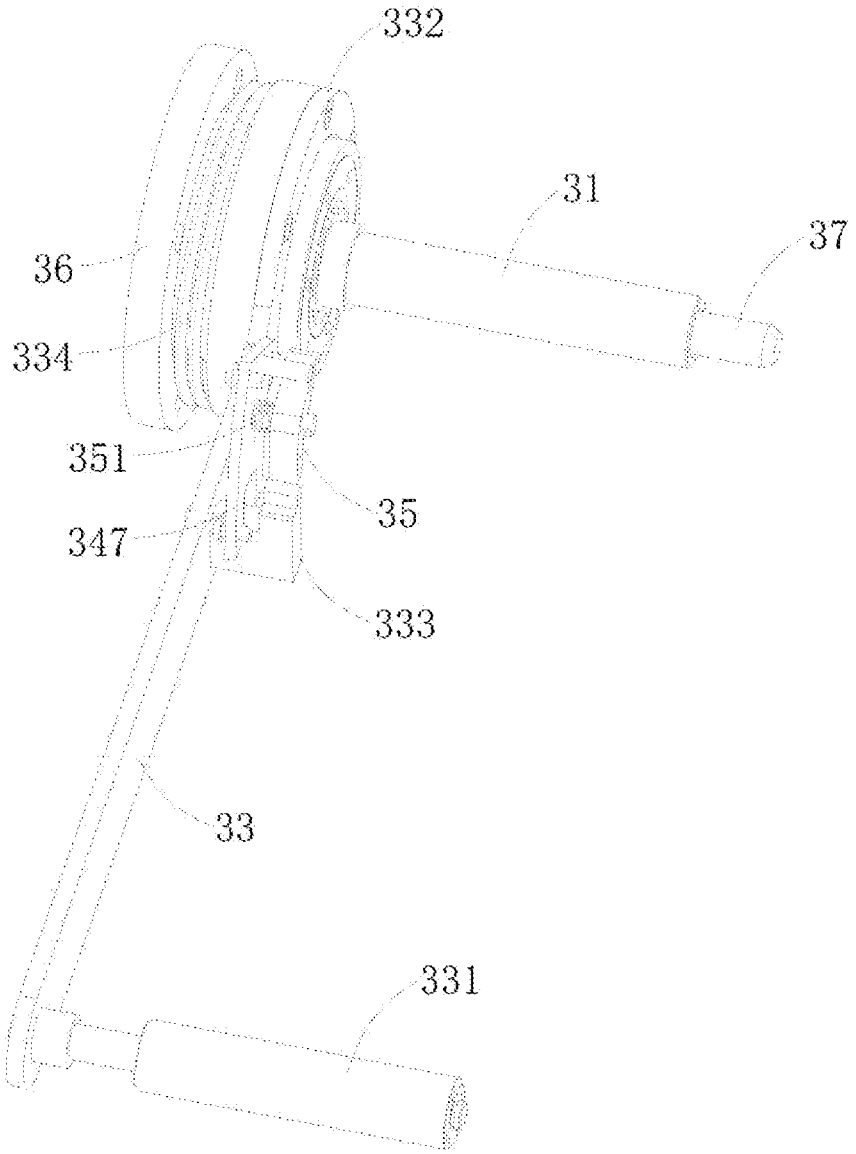
FIG. 10 is a schematic view of a three-dimensional structure for connection between a swing arm and each of a bearing block and a shifting card.

As shown in FIG. 9 and FIG. 10, one end of the swing arm 33 is provided with a connecting ring 332, a second bearing 362 is fixed outside the bearing block 36, the connecting ring 332 fixedly sleeves the outside of the second bearing 362, and thus, a structure that the swing arm. 33 rotates relative to the mounting frame outside the protective cover 34 is formed by the connection between the bearing block 36 and the second bearing 362. In addition, one end of the swing arm 33 is provided with a driving roller 331, and the tape 21 passes by the driving roller 331 after being pulled out, so that the tape 21 drags the driving roller 331 and drives the swing arm 33 to swing.

As shown in FIG. 4 and FIG. 8, one side of the second bearing 362 is further sleeved with a second torsional spring 334 outside the bearing block 36, two ends of the second torsional spring 334 are respectively inserted into the bearing block 36 and the swing arm 33, and the swing arm 33 is pushed by the torsion of the second torsional spring 334 to swing to the shifting card 35. Specifically, when an unwinding rotation torsion formed by pulling out the tape 21 to drive the disk gear 32 to rotate is consistent with the torsion of the second torsional spring 334, the disk gear 32 rotates at a constant speed; when an unwinding speed (i.e., rotating speed) of the disk gear 32 is smaller than a speed that the carton sealer pulls out the tape 21 the tape 21, the swing arm 33 is further pulled to swing to a direction away from the shifting card 35, which further increases the torsion of the second torsional spring 334, therefore, a torsion of the swing arm 33 acting on the outer shaft 31 is also increased, and this torsion makes the outer shaft 31 perform accelerative rotation to reach a speed consistent with the speed that the carton sealer pulls out the tape 21 the tape 21; otherwise, when the unwinding speed of the disk gear 32 is larger than the speed that the carton sealer pulls out the tape 21 the tape 21, the swing arm 33 swings at a smaller angle and is even closer to the shifting card 35, at the same time, the torsion of the second torsional spring 334 becomes small, and therefore, the torsion of the swing arm 33 acting on the outer shaft 31 is also reduced, and the outer shaft 31 performs decelerative rotation to reach a speed consistent with the speed that the carton sealer pulls out the tape 21. Thus, it can be seen that the structures of the above-mentioned swing arm 33 and second torsional spring 334 can ensure that the rotating speed of the outer shaft 31 is consistent with the speed that the carton sealer pulls out the tape 21, so that the unwinding device in the present disclosure can stably output the tape.

Figure 12:
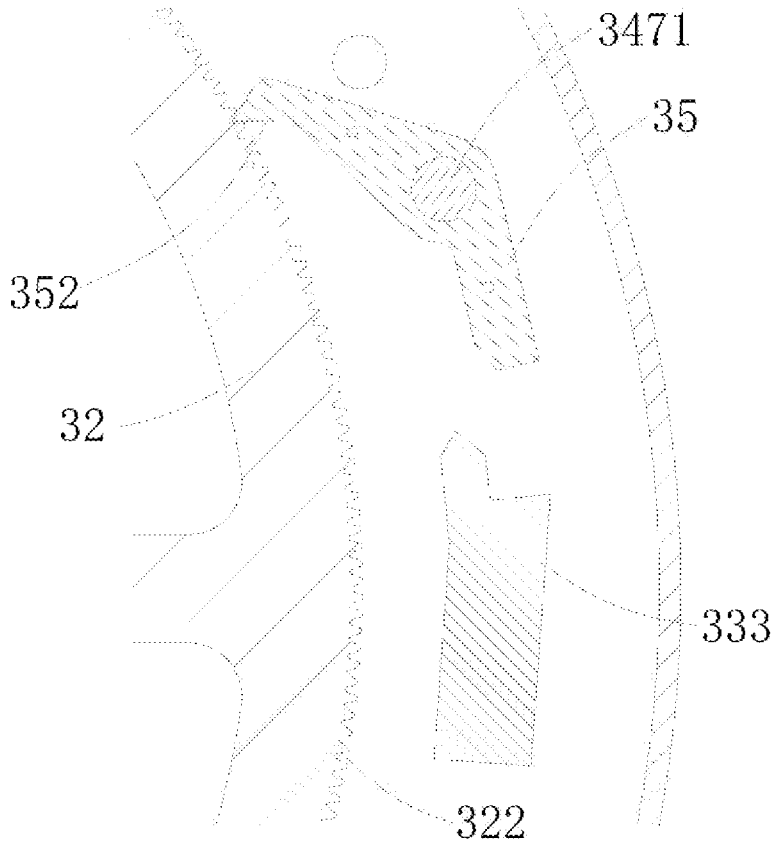
FIG. 12 is a schematic view of connection between the shifting card and each of a disk gear and an insert in FIG. 11.

Further refer to FIG. 7, FIG. 8 and FIG. 10, one side of the swing arm is further provided with an insert 333, an arc-shaped avoidance gap 348 shown in FIG. 1 is further formed in one side of the protective cover 34, and the insert 333 cooperates with the shifting card 35 after passing through the avoidance gap 348 to reach the inside of the protective cover 34. Such a cooperation process is that, when the tape 21 is not pulled out, the swing arm 33 is free of traction from the tape 21, at the moment, the swing arm. 33 swings until the insert 333 supports against the shifting card 35 to be away from an end inserted into the toothed groove 322, that is, as shown in FIG. 12, the insert 333 upwards moves to be inserted into the left of the lower end of the shifting card 35, which ensures that the upper end of the shifting card 35 swings to be kept inserted into the toothed groove 322, then, the end, away from the disk gear 32, of the shifting card 35 is blocked, the shifting card 35 is kept inserted in the toothed groove 322 of the disk gear 32, then, the disk gear 32 cannot rotate, and therefore, the outer shaft 31 and the tape roll 2 cannot rotate either to be self-locked, the situation that the tape 21 is further unwound and loosened due to the inertia brought by prior rotation when the tape 21 stops being unwound is avoided, and it is beneficial to the improvement of unwinding stability.

In conclusion, as shown in FIG. 9 and FIG. 10, in a process that the tape 21 is unwound, the swing arm 33 swings anticlockwise under the action of the tension of the tape 21 to separate the insert 333 from the shifting card 35, so that the shifting card 35 swings to be inserted into the toothed groove 322 of the disk gear 32 under the action of a torsion of the second torsional spring 334, at the same time, the tape 21 is unwound to drive the disk gear 32 to rotate, so that the guide surface 352 on an end of the shifting card 35 is pushed out by the disk gear 32, and then, the shifting card 35 is pushed out of the toothed groove 33. Such a circulation is equivalent to the formation of a directional resistance caused during rotation of the disk gear 32 and the outer shaft 31 in an unwinding process by the shifting card 35, and is beneficial to the reduction of a rotational acceleration during unwinding and the improvement of unwinding stability. When the tape 21 is not acted by an external force due to the ending of the unwinding of the tape 21, the disk gear 32 stops rotating, at the same time, the swing arm 33 swings under the action of the first torsional spring 351 until the insert 333 is inserted into a limiting slot 353 of the shifting card 35 to push the end of the shifting card 35 to be inserted into the toothed groove 322 and block the shifting card 35, so that the shifting card 35 cannot swing, then, the disk gear 32 is stuck by the shifting card 35, and the tape roll 2 cannot rotate to be further unwound. Thus, it can be seen that, by adopting the structure of the present disclosure, the insert 333 pushes the end of the shifting card 35 to be inserted into the toothed groove 322 of the disk gear 32, so that the outer shaft 31 can be self-locked and fixed, the tape roll 2 fixedly sleeving the outside of the outer shaft 31 can be self-locked and fixed, a situation that the tape 21 is loosened due to self-rotation of the tape roll can be avoided, and affecting the stability of pulling the tape 21 later can be avoided.

The above descriptions are only specific implementations of the present disclosure, however, the design concept of the present disclosure is not limited thereto. Any non-substantive changes on the present disclosure based on this concept should fall within behaviors that violate the protection scope of the present disclosure.

What is claimed is:

1. A tape unwinding device with a self-locking function, wherein the device comprises:

an outer shaft connected to a mounting frame to rotate, a tape roll sleeving the outer shaft so as to be fixed relative to the outer shaft;

a disk gear fixedly connected with the outer shaft;

a shifting card connected to the mounting frame to rotate, a first torsional spring being mounted between the shifting card and the mounting frame, and the shifting card being pulled by a torsion of the first torsional spring to swing to the disk gear, so that the shifting card swings to be inserted into a toothed groove of the disk gear; and a swing arm connected to the mounting frame to rotate, one end of the swing arm being provided with a driving roller, and a tape passing by the driving roller after being pulled out, so that the tape drags the driving roller and drives the swing arm to swing to a direction away from the shifting card;

wherein one side of the swing arm is further provided with an insert, and when the tape is not pulled out, the swing arm swings until the insert supports against the shifting card to be away from an end inserted into the toothed groove, so that the shifting card swings to be inserted into the toothed groove.

2. The tape unwinding device with a self-locking function according to claim 1, wherein a bearing block is fixed on the mounting frame, a first bearing is embedded and fixed in the bearing block, and the outer shaft is fixed in an inner ring of the first bearing.

3. The tape unwinding device with a self-locking function according to claim 2, wherein an expansion sleeve is fixed outside the outer shaft, and a through hole in the center of the tape roll fixedly sleeves a cylindrical surface sleeving outside the expansion sleeve, so that the tape roll is fixed relative to the outer shaft.

4. The tape unwinding device with a self-locking function according to claim 1, wherein a bearing block is fixed on the mounting frame, a second bearing is nested and fixed outside the bearing block, one end of the swing arm is provided with a connecting ring, and the connecting ring fixedly sleeves the outside of the second bearing.

5. The tape unwinding device with a self-locking function according to claim 1, wherein a clamping slot is formed in the center of the disk gear, an expanded copling sleeve is embedded into the clamping slot in an interference fit way, and the expanded copling sleeve sleeves the outside of the outer shaft in an interference fit way, so that the disk gear is fixed relative to the outer shaft.

6. The tape unwinding device with a self-locking function according to claim 1, wherein the device further comprises a protective cover fixed on one side of the mounting frame, the disk gear, the shifting card and the first torsional spring are all located in the protective cover, the shifting card is connected to the inside of the protective cover to rotate, an are-shaped avoidance gap is further formed in one side of the protective cover, and the insert cooperates with the shifting card after passing through the avoidance gap to reach the inside of the protective cover.

7. The tape unwinding device with a self-locking function according to claim 6, wherein the protective cover comprises a cover shell and a first protective plate, the cover shell is fixed to one side of the mounting frame, an assembly space is formed inside the cover shell, the disk gear, the shifting card and the first torsional spring are all located in the assembly space, an opening of the assembly space is sealed by the first protective plate, and the outer shaft passes through the cover shell to reach the inside of the first protective plate, so that the tape roll is located in the first protective plate after being connected to the outer shaft.

8. The tape unwinding device with a self-locking function according to claim 7, wherein the protective cover further comprises a second protective plate, and the second protective plate is fixed on the other end, opposite to the first protective plate, of the outer shaft, so that the tape roll is located between the first protective plate and the second protective plate.

9. The tape unwinding device with a self-locking function according to claim 8, wherein a central shaft is fixed on the mounting frame, and the central shaft passes through the outer shaft; a clamping part is fixed in the middle of the second protective plate, a connecting hole adapted to an end of the central shaft is formed in the center of the clamping part, a cutting groove is formed in one side of the clamping part, the cutting groove inwards extends to the connecting hole, the clamping part is provided with a notch along a radius line thereof, and the notch communicates with the connecting hole and the cutting groove, so that a part, facing away from the second protective plate after the clamping part is separated by the cutting groove and the notch, of the clamping part forms a clamping piece, and after the connecting hole sleeves the end of the central shaft, the clamping piece moves from one side to the other side of the notch until the connecting hole is tightly clamped by the end of the central shaft.

10. The tape unwinding device with a self-locking function according to claim 9, wherein the protective cover further comprises a conical sleeve handle, a threaded hole is formed in the second protective plate, the conical sleeve handle is adapted to and spirally connected with the threaded hole, the clamping piece is provided with a moving hole in one side of the notch, the moving hole and the threaded hole are eccentric, the conical sleeve handle is further provided with a conical guide part, and when the conical sleeve handle is screwed into the threaded hole, the guide part supports against a side wall of the moving hole so as to drive a side, provided with the moving hole, of the clamping piece to move to the other side of the notch.

* * * * *